US011421909B2

(12) United States Patent
Lozano

(10) Patent No.: US 11,421,909 B2
(45) Date of Patent: Aug. 23, 2022

(54) INTERCHANGEABLE HVAC DUCTS

(71) Applicant: DENSO International America, Inc., Southfield, MI (US)

(72) Inventor: Michael Lozano, Detroit, MI (US)

(73) Assignee: DENSO International America, Inc., Southfield, MI (US)

( * ) Notice: Subject to any disclaimer, the term of this patent is extended or adjusted under 35 U.S.C. 154(b) by 238 days.

(21) Appl. No.: 16/833,557

(22) Filed: Mar. 28, 2020

(65) Prior Publication Data

US 2021/0302057 A1 Sep. 30, 2021

(51) Int. Cl.
*F24F 1/005* (2019.01)
*F24F 13/02* (2006.01)

(52) U.S. Cl.
CPC ..... *F24F 13/0254* (2013.01); *F24F 1/005* (2019.02); *F24F 13/0218* (2013.01); *F24F 2221/125* (2013.01)

(58) Field of Classification Search
CPC ..... F24F 13/0254; F24F 13/08; F24F 13/081; F24F 1/005; F24F 1/0014; F24F 13/0218; F24F 2221/125; F24F 2221/12; F24F 1/04; F24F 2221/42
USPC ..... 454/21, 9, 233, 268
See application file for complete search history.

(56) References Cited

U.S. PATENT DOCUMENTS

| | | | | |
|---|---|---|---|---|
| 5,360,239 | A | 11/1994 | Klementich | |
| 2015/0099454 | A1* | 4/2015 | Hikmet | F24F 7/04 454/284 |
| 2015/0128483 | A1* | 5/2015 | Krupp | F24D 5/02 43/132.1 |
| 2016/0097547 | A1 | 4/2016 | Selg et al. | |
| 2017/0254557 | A1 | 9/2017 | Chiu | |

* cited by examiner

*Primary Examiner* — Avinash A Savani
*Assistant Examiner* — Ryan L Faulkner
(74) *Attorney, Agent, or Firm* — Harness, Dickey & Pierce, P.L.C.

(57) ABSTRACT

A portable heating, ventilation, and air conditioning (HVAC) unit includes a housing, a plate, and a duct assembly. The housing defines a first airflow exit and a second airflow exit. The first airflow exit is separated from the second airflow exit by a portion of the housing. The plate is configured to cover the first airflow exit. The duct assembly is configured to cover the second airflow exit. The plate is configured to be disassembled from the housing and reassembled to cover the second airflow exit, and the duct assembly is configured to be disassembled from the housing and reassembled to cover the first airflow exit.

18 Claims, 6 Drawing Sheets

INTERCHANGEABLE HVAC DUCTS

FIELD

The present disclosure relates to portable heating, ventilation, and air conditioning (HVAC) units, and, more specifically, to interchangeable ducts for a portable HVAC units.

BACKGROUND

This section provides background information related to the present disclosure which is not necessarily prior art.

Movable, or portable, heating, ventilation, and air conditioning (HVAC) units are commonly used to temporarily heat or cool a first space and then, subsequently, heat or cool a second, different, space. Portable HVAC units work by pulling stagnant air from inside the room. The motor inside the unit then cools the air for circulation throughout the space. Air ducts for movable HVAC units are fixed in one position. Having fixed air ducts often causes issues during shipping or transportation.

SUMMARY

This section provides a general summary of the disclosure, and is not a comprehensive disclosure of its full scope or all of its features.

At least one example embodiment of a portable heating, ventilation, and air conditioning (HVAC) unit according to the present disclosure includes a housing, a plate, and a duct assembly. The housing defines a first airflow exit and a second airflow exit. The first airflow exit is separated from the second airflow exit by a portion of the housing. The plate is configured to cover the first airflow exit. The duct assembly is configured to cover the second airflow exit. The plate is configured to be disassembled from the housing and reassembled to cover the second airflow exit, and the duct assembly is configured to be disassembled from the housing and reassembled to cover the first airflow exit.

In at least one example embodiment, the plate may include a top plate and a first fin. The first fin may extend orthogonal to the top plate.

In at least one example embodiment, the first fin may be configured to direct an airflow through the housing.

In at least one example embodiment, the duct assembly may include at least two ducts.

In at least one example embodiment, the first fin may be one of a plurality of fins, and a number of fins in the plurality of fins may be one less than a number of ducts in the at least two ducts.

In at least one example embodiment, the top plate may be fixed to the housing by a plurality of removable fasteners.

In at least one example embodiment, the plate may include a wedge disposed between the top plate and the first fin.

In at least one example embodiment, the wedge may include an angle within a range of about 30° to about 60°.

In at least one example embodiment, the duct assembly may include a duct plate. The duct plate may have a same size and perimeter shape as a size and perimeter shape of the top plate.

In at least one example embodiment, the duct assembly may include a duct plate and a duct. The duct may align with an aperture defined by the duct plate.

In at least one example embodiment, the duct may be fixed to the duct assembly by a fastening ring.

In at least one example embodiment, the duct plate may be fixed to the housing by a plurality of removable fasteners.

In at least one example embodiment, the plate may be fixed to the housing by a plurality of removable fasteners.

In at least one example embodiment, the duct assembly may be fixed to the housing by a plurality of removable fasteners.

At least one example embodiment of a duct assembly according to the present disclosure for a heating, ventilation, and air conditioning (HVAC) unit having a housing includes a duct plate and a duct. The duct plate defines an aperture. The duct is fixed to the duct plate and alighted with the aperture. The duct plate includes a plurality of fastening apertures. Each of the plurality of fastening apertures is configured to receive a removable fastener for fastening the duct plate to the housing of the HVAC unit.

In at least one example embodiment, a fastening ring may be configured to fasten the duct to the duct plate.

In at least one example embodiment, the duct plate may include a protrusion around a perimeter of the aperture. A first end of the duct may be slidably received over the protrusion, and the fastening ring may be configured to tighten the first end of the duct on the protrusion and fix the duct to the duct plate.

In at least one example embodiment, an end ring may be configured to cover a free end of the duct.

In at least one example embodiment, the duct plate may be sized to cover at least two airflow exits in the housing of the HVAC unit. The duct plate may cover one of the at least two airflow exits at a time.

In at least one example embodiment, the duct may be one of two ducts fixed to the duct plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
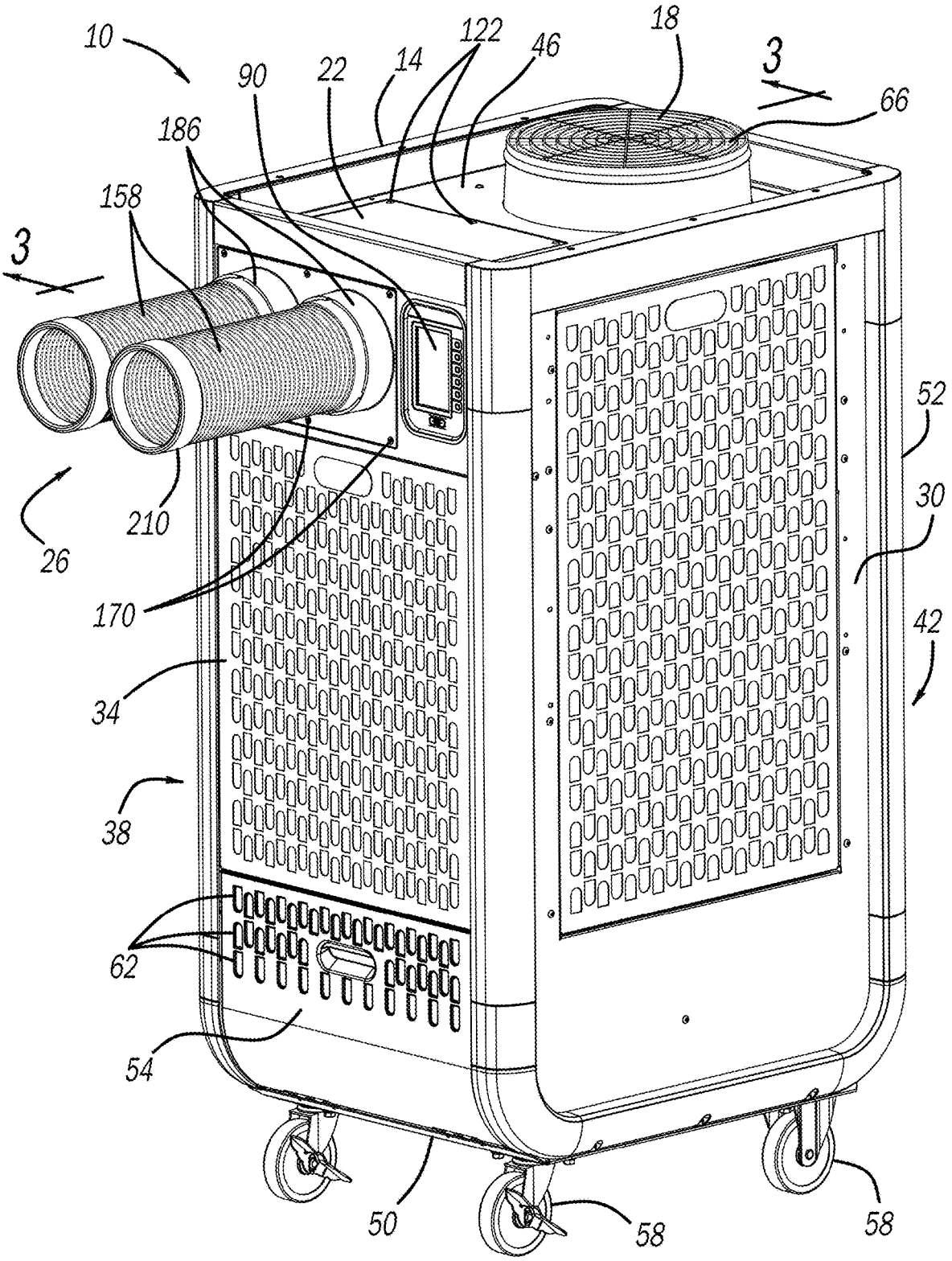
FIG. 1 is a perspective view of at least one example embodiment of a heating, ventilation, and air conditioning (HVAC) unit according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, an example embodiment of a heating, ventilation, and air conditioning (HVAC) unit 10 according to the present disclosure is illustrated. The HVAC unit 10 may include a housing 14, a fan shroud 18, a vent cover 22, and a duct assembly 26. The HVAC unit 10 may be a portable, or movable unit, meaning that the HVAC unit 10 may be compact enough to be moved from location to location for HVAC needs. Additionally, the HVAC unit 10 may not be permanently fixed to any structure.

The housing 14 may be formed of a metal or polymer, such as, for example, aluminum, steel, alloys, plastic, combinations thereof, or any other suitable material. The housing 14 may be formed by pressing, rolling, molding (such as injection or blow molding), or any other suitable method.

In at least one example embodiment, the housing 14 may include four side panels 30, 34, 38, 42, a top panel 46, and a bottom panel 50 that are fixed to and supported by a frame 52. The housing 14 may additionally include an intake vent 54. In at least one example embodiment, the housing may additionally include an electrical cord inlet or power supply inlet. The housing 14 may be supported on wheels 58 for ease in mobility. The wheels 58 may be rotatably fixed to the bottom panel 50 of the housing. In at least one example embodiment, four wheels 58 may be fixed around a perimeter of, or in corners of, the bottom panel 50 of the housing.

In at least one example embodiment, the intake vent 54 may be disposed in one of the side panels 30, 34, 38, 42 of the housing 14 and may provide an air inlet into the housing 14. For example, the intake vent 54 may be a slotted grid that allows air to flow in the housing 14. In at least one example embodiment, the intake vent 54 may be an area of the side panel 30, 34, 38, 42 having a series of apertures 62 providing access from the environment into the housing 14.

In at least one example embodiment, the intake vent 54 may be one of several intake vents 54 disposed in multiple side panels 30, 34, 38, 42 of the housing 14.

In at least one example embodiment, the intake vent 54 may be formed of the same material as the housing 14 and may be integral with the housing 14. For example, the intake vent 54 may be formed of a metal or polymer, such as, for example, aluminum, steel, alloys, plastic, combinations thereof, or any other suitable material.

In at least one alternative example embodiment, the intake vent 54 may be formed of the same material as the housing 14 but may be separate and removable from the housing 14. In at least one alternative example embodiment, the intake vent 54 may be formed of a different material from the housing 14 and may be separate and removable from the housing 14.

In at least one example embodiment, an electrical cord may supply power from a power source (not illustrated) to parts housed within the housing 14 (described below). The electrical cord may be a flexible, tubular housing enclosing wiring that delivers power from the power source to the HVAC unit 10.

In at least one example embodiment, the fan shroud 18 may be disposed in the top panel 46 of the housing 14 and may house a fan or blower that vents air out of the housing 14. The fan shroud 18 may protrude from the top panel 46 of the housing 14 and may include slots 66 therein that allow the airflow from the fan to escape. In at least one example embodiment, the fan shroud 18 may be circular or cylindrical. However, it is understood that the fan shroud 18 may have any shape as long as the fan shroud 18 is sized to house the blades of the fan.

In at least one example embodiment, the fan shroud 18 may be formed of the same material as the housing 14 and may be integral with the housing 14. For example, the fan shroud 18 may be formed of a metal or polymer, such as, for example, aluminum, steel, alloys, plastic, combinations thereof, or any other suitable material. In at least one example embodiment, the fan shroud 18 may be a portion of the top panel 46 and may be integral therewith.

In at least one alternative example embodiment, the fan shroud 18 may be formed of a different material and/or may be separate from the housing 14. The fan shroud 18 may be fixed to the housing by adhesive, welding, fasteners (such as screws or bolts), etc.

Figure 2:
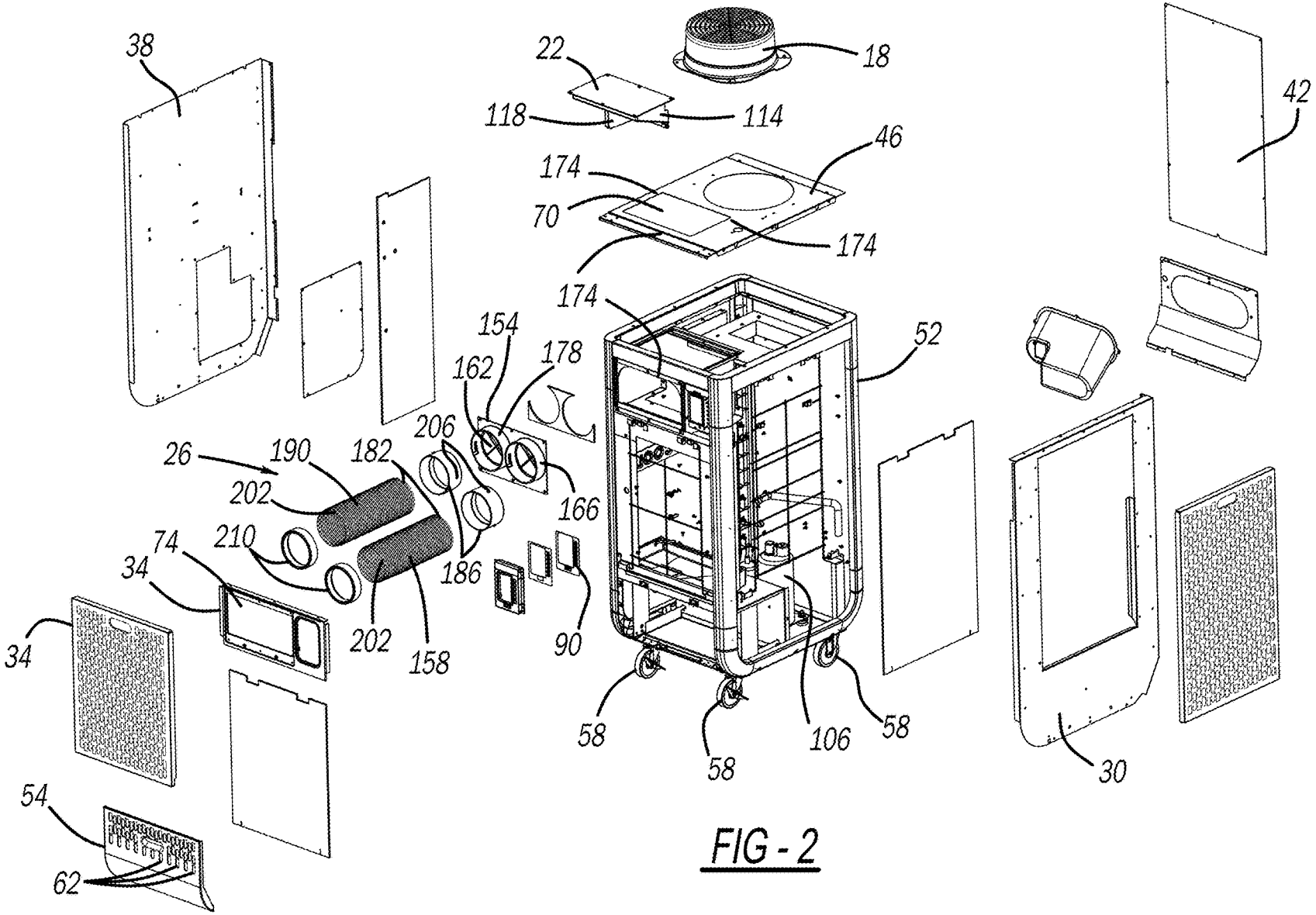
FIG. 2 is an exploded view of the HVAC unit in FIG. 1.

Referring additionally to FIG. 2, in at least one example embodiment, the housing 14 may define an airflow exit 70 in the top panel 46 of the housing 14 and an airflow exit 74 in at least one side panel 30, 34, 38, 42 of the housing 14. The airflow exits 70, 74 may be apertures in the top panel 46 and side panel 30, 34, 38, 42, respectively that define a location for receiving the vent cover 22 and/or duct assembly 26. In at least one example embodiment, the airflow exits 70, 74 may be the same shape and size such that each airflow exit 70, 74 can receive both the vent cover 22 and the duct assembly 26. In at least one example embodiment, the airflow exits 70, 74 may be rectangular-shaped apertures. However, it is understood that the airflow exits 70, 74 may have any shape, as long as the airflow exit 70, 74 is configured to engage with the vent cover 22 and duct assembly 26.

Figure 3:
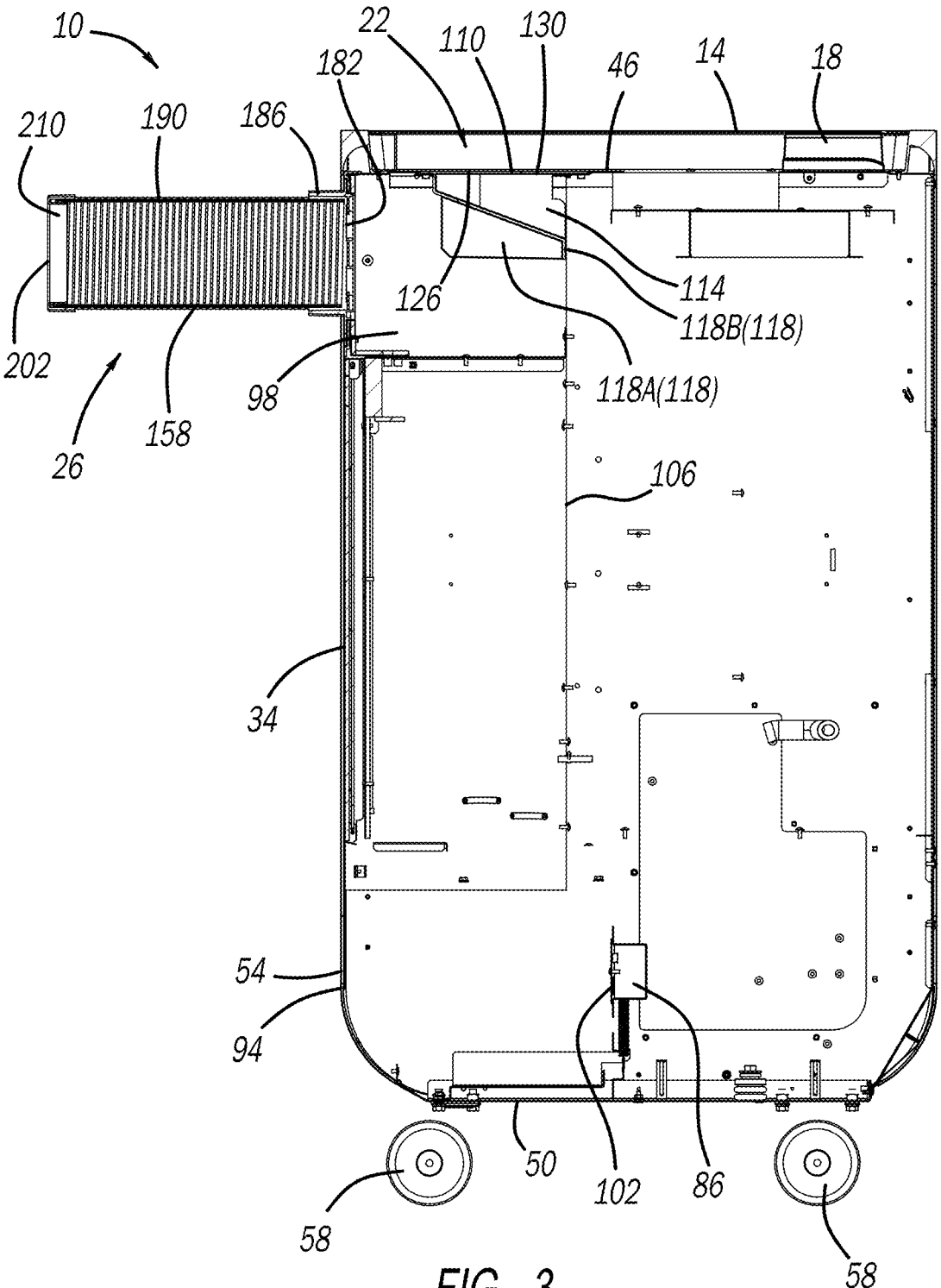
FIG. 3 is a cross sectional view of the HVAC unit in FIG. 1 taken along line 3-3.

Now referring to FIG. 3, the housing 14 may define an internal space housing components of the HVAC unit 10. For example, the housing 14 may support a motor 86, a control panel 90 (FIG. 1), a filter 94, and an air box 98. Although not described herein, it is understood that various other parts (such as a compressor, an evaporator, a condenser, liquid coolant lines, a fan, etc.) that support operation of the HVAC unit 10 may be housed within the housing 14.

In at least one example embodiment, the motor 86 may be a fan motor or blower motor that operates a fan 102 to suck air in through the intake vent 54 and filter 94. The air sucked in through the intake vent 54 and filter 94 is cooled within the housing 14 and pushed out of the housing through the air box 98 and duct assembly 26.

In at least one example embodiment, the control panel 90 may control operation of the motor 86 and various other HVAC components housed within the HVAC unit 10 (for example, the compressor, the evaporator, the condenser, the fan, etc.). The control panel 90 may receive power from the power source and may include a controller configured to execute code to control the various HVAC unit 10 components.

In this application, including the definitions below, the term "control module" or the term "controller" may be replaced with the term "circuit." The term "control module" may refer to, be part of, or include processor hardware (shared, dedicated, or group) that executes code and memory hardware (shared, dedicated, or group) that stores code executed by the processor hardware. The code is configured to provide the features of the modules, controllers, and systems described herein. The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

In at least one example embodiment, the air box 98 may be a space defined by the frame 50, the side panels 30, 34, 38, and an internal panel 106. The air box may receive the heated or cooled air from the HVAC components (e.g., compressor, condenser, evaporator, etc.) within the housing 14 and may cooperate with the vent cover 22 and duct assembly 26 to discharge the air out of the housing 14.

Figure 4:
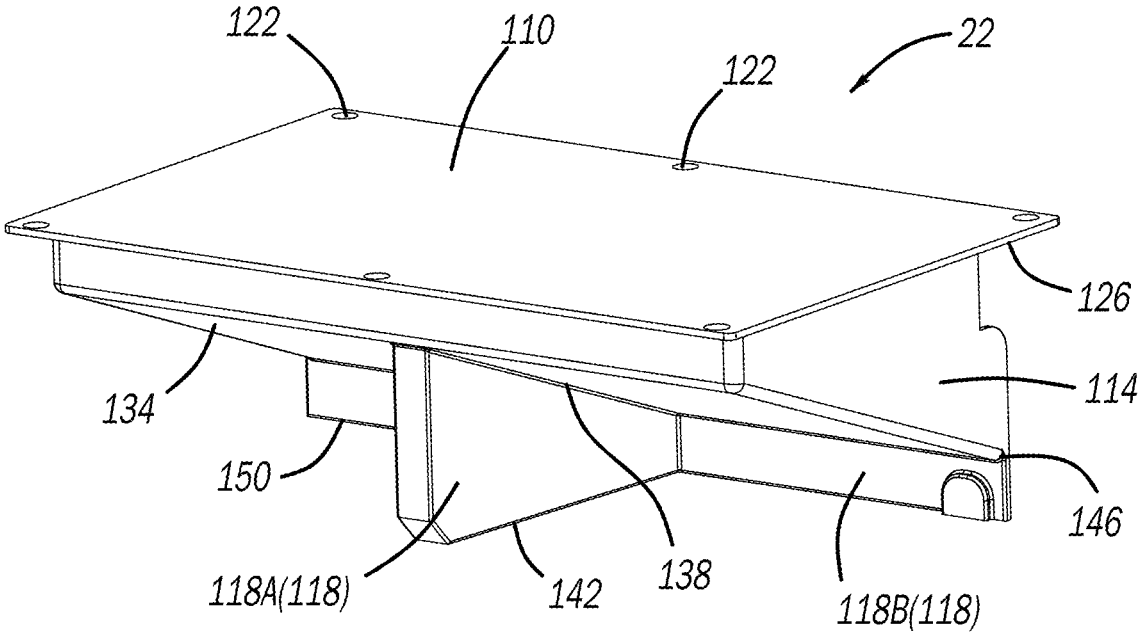
FIG. 4 is a perspective view of at least one example embodiment of a vent cover for the HVAC unit in FIG. 1.

Now referring to FIGS. 3 and 4, in at least one example embodiment, the vent cover 22 may be a duct plate that removably fixes to the housing 14. The vent cover 22 may include a top plate 110, a wedge body 114, and at least one louvre or fin 118 extending from the wedge body 114. In at least one example embodiment, the top plate 110 of the vent cover 22 may include apertures 122 on a perimeter thereof that engage with fasteners (e.g., screws or bolts, etc.) to fasten the vent cover 22 to the housing 14. The fasteners may engage with apertures in the housing 14 that are disposed around a perimeter of the airflow exits 70, 74 for removably fixing the vent cover 22.

In at least one example embodiment, a top surface 130 of the wedge body 114 may be disposed on, and engaged with, a bottom surface 126 of the top plate 110. The top surface 130 may be a planar surface that extends parallel with the bottom surface 126 of the top plate 110 and, when assembled, the top panel 46.

In at least one example embodiment, a bottom surface 134 of the wedge body 114 may be angled relative to the top surface 130. For example, the bottom surface 134 may extend at an angle within a range of about 30° to about 60° from the top surface 130. More specifically, the bottom surface 134 may extend at an angle of about 45° from, or relative to, the top surface 130.

In at least one example embodiment, the vent cover 22 may redirect air from the air box 98 exiting the airflow exit 70, 74 to which the duct assembly 26 is attached. The bottom surface 134 of the wedge body 114 may cooperate with the fins 118 to direct the airflow out of the airflow exit 70, 74. In at least one example embodiment, a lateral fin 118A may extend from the bottom surface 134 of the wedge body 114 across a width of the top plate 110. In at least one example embodiment, the lateral fin 118A may be a plate-shaped fin having an angled top surface 138 and a flat bottom surface 142. For example, the top surface 138 of the lateral fin 118A may be disposed on, and engaged with, the bottom surface 134 of the wedge body 114. Thus, the top surface 138 of the lateral fin 118A may be angled relative to the top surface 130 of the wedge body 114 (and the bottom surface 142 of the lateral fin 118A). For example, the top surface 138 of the lateral fin 118A may extend at an angle within a range of about 30° to about 60° from the top surface 130 of the wedge body 114 (and the bottom surface 142 of the lateral fin 118A). More specifically, the top surface 138 of the lateral fin 118A may extend at an angle of about 45° from, or relative to, the top surface 130 of the wedge body 114 (and the bottom surface 142 of the lateral fin 118A). The bottom surface 142 of the lateral fin 118A, previously mentioned, may extend parallel with the bottom surface 126 of the top plate 110 and the top surface 130 of the wedge body 114.

In at least one example embodiment, a longitudinal fin 118B may extend from the bottom surface 134 of the wedge body 114 along a length of the top plate 110. For example, a top surface 146 of the longitudinal fin 1188 may be disposed on, and engaged with, the bottom surface 134 of the wedge body 114 at an end of the wedge body 114 that is furthest separated from the top surface 130 of the wedge body 114. Thus, the top surface 146 of the longitudinal fin 1188 may be parallel with the top surface 130 of the wedge body 114. A bottom surface 150 of the longitudinal fin 1188 may be parallel with the top surface of the wedge body 114 and disposed on a same plane as the bottom surface 142 of the lateral fin 118A.

The fins 118 may create channels for the airflow exiting the HVAC unit 10 and housing 14, thereby directing, or redirecting the airflow out of the duct assembly 20. In at least one example embodiment, the number of lateral fins 118A in the vent cover 22 may be determined by the number of ducts (described below) in the duct assembly 26. For example, the number of lateral fins 118A in the vent cover 22 may be one less than the number of ducts in the duct assembly 26. Therefore, if there is a single duct in the duct assembly 26, there will not be any lateral fins 118A in the vent cover 22; if there are two ducts in the duct assembly 26, there is a single lateral fin 118A in the vent cover 22; if there are three ducts in the duct assembly 26, there are two lateral fins 118A in the vent cover 22; and so on. While lateral fins 118A are illustrated and described in the specification, it is understood that the fins 118 could have any configuration that desirably directs, or redirects the airflow. The current configurations are implemented based on test data finding that the current configuration is optimal for the designed air box 98.

Figure 5:
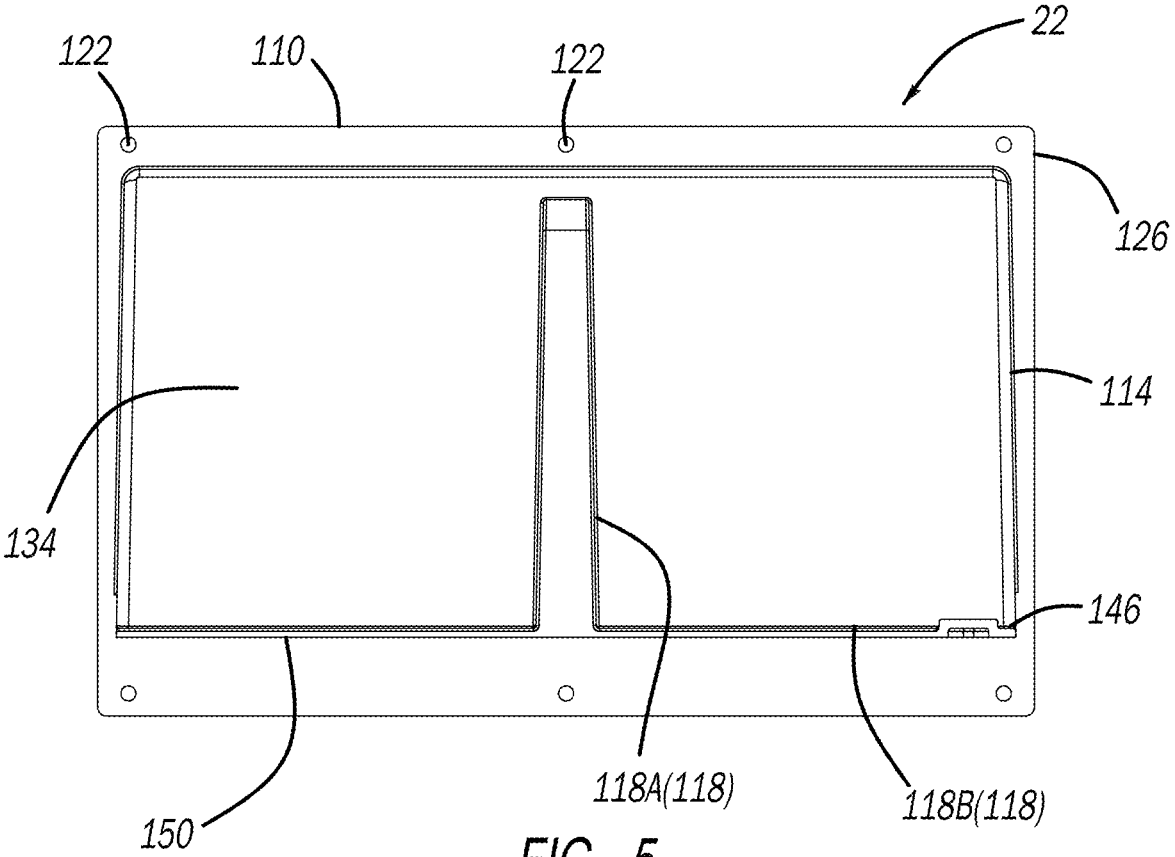
FIG. 5 is a bottom view of the vent cover in FIG. 4.
Figure 6:
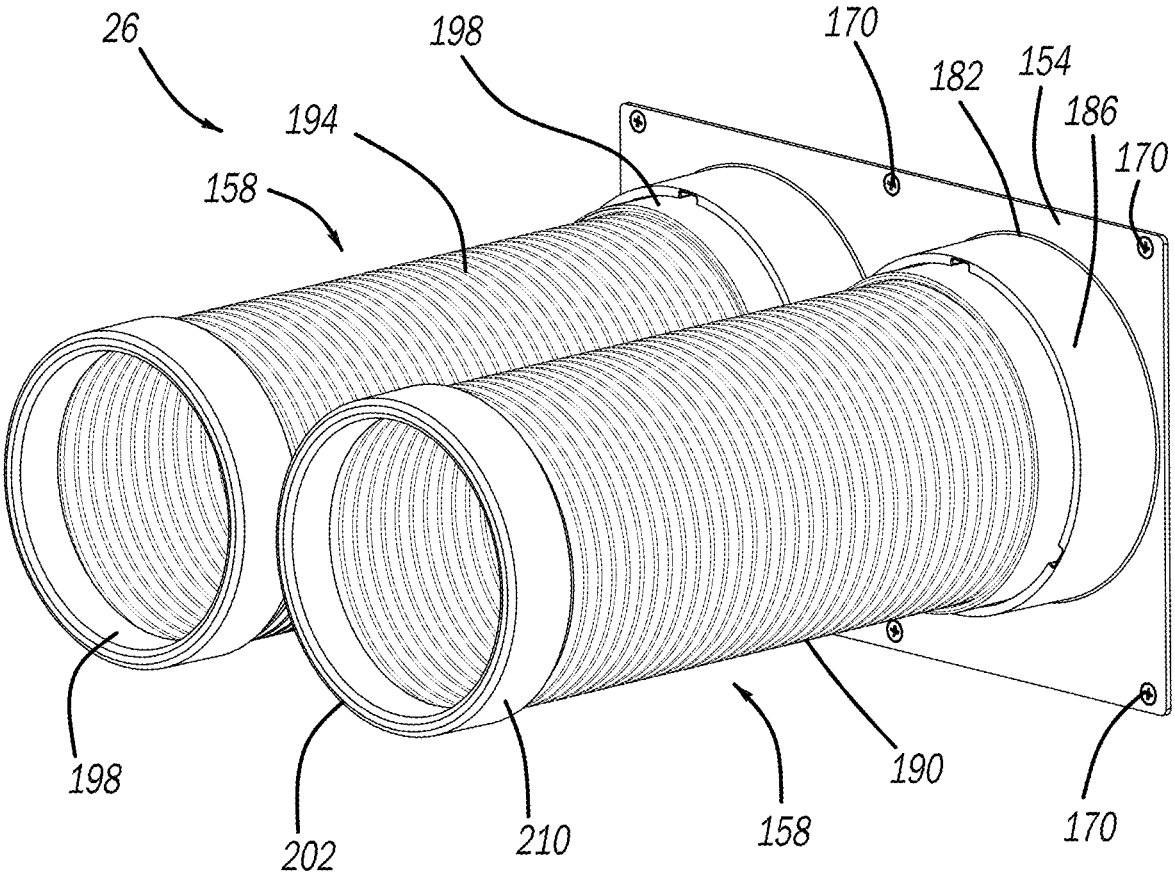
FIG. 6 is a perspective view of at least one example embodiment of a duct assembly for the HVAC unit in FIG. 1.
Figure 7:
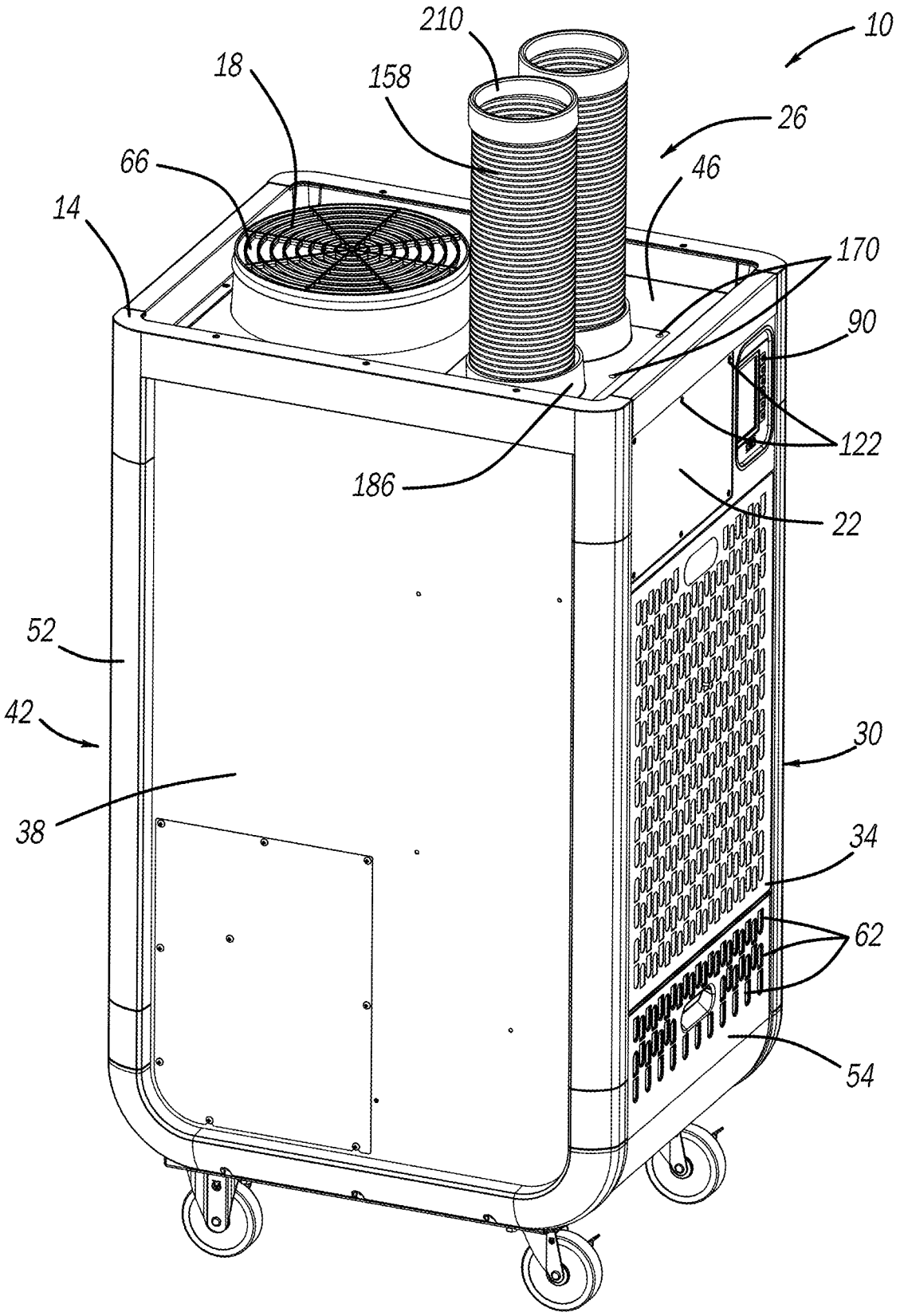
FIG. 7 is a perspective view of another configuration for the HVAC unit in FIG. 1.

Now referring to FIGS. 2, 3, and 5, in at least one example embodiment, the duct assembly 26 may include a plate 154 and at least one duct 158 fixed to the plate 154. For example, as illustrated, a pair of ducts 158 may be fixed to the plate 154. In at least one alternative example embodiment, a single duct 158, three ducts 158, or any number of ducts 158 may be fixed to the plate 154.

In at least one example embodiment, the plate 154 may be a planar plate having at least one aperture 162 and at least one tubular protrusion 166 around a perimeter of the aperture 162. For example, as illustrated, the plate 154 may be a planar plate having a pair of apertures 162 and a pair of tubular protrusions 166 around the perimeter of the apertures (i.e., one protrusion 166 around the perimeter of each aperture 162). In an alternative example embodiment, the plate 154 may be a planar plate having a single aperture 162, three apertures 162, or any number of apertures 162 that matches the number of ducts 158 in the duct assembly and having a single protrusion 166, three protrusions 166, or any number of protrusions that matches the number of apertures 162 in the plate 154.

In at least one example embodiment, the plate 154 may be formed of metal (such as sheet metal, aluminum, steel, an alloy, or a combination thereof), a polymer (such as plastic, etc.), or any other suitable material. The plate 154 may be formed by bending, rolling, stamping, molding (such as blow molding, injection molding, etc.), casting, or any other suitable process. In at least one example embodiment, the protrusion 166 may be formed integral to the plate 154, such as by stamping, molding, or any other suitable process. In at least one alternative example embodiment, the protrusion 166 may be formed separate from the plate 154 and fixed to the plate 154 by welding, adhesive, or any other suitable process.

In at least one example embodiment, the plate 154 may be removably fixed to the housing 14. For example, the plate 154 may include a plurality of apertures 170 disposed around a perimeter of the plate 154 that are configured to receive fasteners (for example, screws, bolts, etc.). The fasteners (not illustrated) may engage with apertures 174 in the housing 14 that are disposed around a perimeter of the airflow exits 70, 74 for removably fixing the plate 154 to the housing 14.

In at least one example embodiment, the duct 158 may have a tubular or pipe structure with a first end 182 and a second end 202. For example, the duct 158 may be a cylindrical tube, a tube having a rectangular cross section, a tube having a square cross section, or any other-shaped cross section that mates with a shape of the aperture 162 in the plate 154.

In at least one example embodiment, the duct 158 may include a corrugated portion 194 and a non-corrugated portion 198. For example, the duct 158 may include two non-corrugated portions 198 that may be on the first end 182 and the second end 202 of the duct 158, and the corrugated portion 194 may be between the non-corrugated portions 198 and in a central portion of the duct 158.

The corrugated portion 194 may allow for bending and/or positioning of the duct 158. For example, the corrugated portion 194 may allow the second end 202 of the duct 158 to be positioned relative to the first end 182 of the duct 158. More specifically, the corrugated portion 194 may be bendable or flexible such that the first end 182 of the duct 158 may be positioned along a first axis at the plate 154, and the second end 202 of the duct may be positioned along a second axis which can either be aligned with the first axis or intersecting the first axis.

In at least one example embodiment, the duct 158 may mate with the protrusion 166 on the plate 154. For example, the duct 158, having the same cross sectional shape as the protrusion 166 and the aperture 162, may fit on an outer surface 178 of the protrusion 166. In at least one example embodiment, the duct 158 may be slidably fit over the outer surface 178 of the protrusion 166. For example, a first end 182 of the duct 158 may be slidably fit over the outer surface 178 of the protrusion 166. In at least one alternative example embodiment, the first end 182 of the duct 158 may be one of press-fit or threaded on the outer surface 178 of the protrusion.

In at least one example embodiment, the duct 158 may be fixed on the protrusion 166 and to the plate 154 by fastening ring 186. For example, fastening ring 186 may be placed on an exterior surface 190 of the duct 158 at the first end 182 of the duct 158 fit over the protrusion 166. More particularly, the fastening ring 186 may fit over the non-corrugated portion 198 on the first end 182 of the duct 158.

In at least one example embodiment, the fastening ring 186 may include at least one aperture 206 therein for receiving a fastener (for example, a screw, bolt, etc.) to fix the fastening ring 186 on the duct 158 and fix the duct 158 on the protrusion 166. In at least one example embodiment, the fastener may be threaded into the aperture 206 and may apply pressure to the duct 158 to press the duct 158 into the protrusion 166. With sufficient pressure applied to the duct 158, the duct 158 is firmly retained on the protrusion 166. In at least one alternative example embodiment, the fastening ring 186 may be a worm gear clamp, or a hose clamp, or may operate similarly thereto. Thus, as the fastener is threaded into the aperture 206, the fastening ring 186 is tightened around the first end 182 of the duct 158, fixing the first end 182 of the duct 158 on the protrusion 166.

In at least one example embodiment, an end ring 210 may be positioned on or cap the second end 202 of the duct 158. The end ring 210 may be fixed on the non-corrugated portion 198 at the second end 202 to provide additional support or structure and a smooth finish for the second end 202. For example, the end ring 210 may be clamped on the second end 202. Alternatively, the end ring 210 may be press-fit, threaded, or fixed by adhesive on the second end 202.

In at least one example embodiment, the duct 158 may provide an exit for airflow in the housing 14. Referring additionally to FIG. 1, in use, external air may enter the HVAC unit 10 housing 14 through intake vent 54. Motor 86 may operate fan 102 to suck the external air in through the intake vent 54. The external air may be filtered through filter 94 engaged with intake vent 54. Within housing 14, the external air may be heated or cooled by the HVAC components (e.g., the compressor, the condenser, the evaporator, the fan, etc.) and the heated or cooled air is routed or directed into the air box 98. When in the air box 98, the heated or cooled air is directed, or redirected by the fins 118 in the vent cover 22, and particularly, the lateral fin 118A. For example, the lateral fin 118A may separate the heated or cooled air into channels aligning with the aperture(s) 162 in the plate 154 of the duct assembly 26 covering the airflow exit 70, 74. The heated or cooled air then exits the HVAC unit 10 through the duct(s) 158 in the duct assembly 26.

In at least one example embodiment, as shown in FIGS. 1 and 3, the duct assembly 26 may be engaged with the airflow exit 74 in the side panel 34 of the housing 14 and the vent cover 22 may be engaged with the airflow exit 70 in the top panel 46 of the housing 14. However, if a different configuration is desired, the duct assembly 26 may be detached from the side panel 34 by removing the fasteners in apertures 170 and the vent cover 22 may be detached from the top panel 46 by removing the fasteners in apertures 122. The duct assembly 26 may then be re-attached to the top panel 46 by fastening the fasteners in the apertures 170 and the vent cover 22 may be re-attached to the side panel 34 by fastening the fasteners in the apertures 122. Thus, the HVAC unit 10 may be re-configurable for each specific heating and/or cooling job. Additionally, the duct assembly 26 may be removed for transportation to reduce the space occupied by the HVAC unit 10 and make transportation easier. Further, removal of the duct assembly 26 prevents damage to the duct(s) 158 during transportation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A portable heating, ventilation, and air conditioning (HVAC) unit comprising:

a housing defining a first airflow exit and a second airflow exit, the first airflow exit being separated from the second airflow exit by a portion of the housing;

a vent cover configured to cover the first airflow exit; and a duct assembly configured to cover the second airflow exit;

wherein the vent cover is configured to be disassembled from the housing and reassembled to cover the second airflow exit, the duct assembly is configured to be disassembled from the housing and reassembled to cover the first airflow exit, and the vent cover includes a top plate and a first fin, the first fin extending from the top plate.

2. The HVAC unit of claim 1, wherein the first fin extends orthogonal to the top plate.

3. The HVAC unit of claim 1, wherein the first fin is configured to direct an airflow through the housing.

4. The HVAC unit of claim 1, wherein the duct assembly includes at least two ducts.

5. The HVAC unit of claim 4, wherein the first fin is one of at least one fin, and a number of fins in the at least one fin is one less than a number of ducts in the at least two ducts.

6. The HVAC unit of claim 1, wherein the top plate is fixed to the housing by a plurality of removable fasteners.

7. The HVAC unit of claim 1, wherein the vent cover includes a wedge disposed between the top plate and the first fin.

8. The HVAC unit of claim 7, wherein the wedge includes an angle within a range of about 30° to about 60°.

9. The HVAC unit of claim 1, wherein the duct assembly includes a duct plate, the duct plate having a same size and perimeter shape as a size and perimeter shape of the top plate.

10. The HVAC unit of claim 1, wherein the duct assembly includes a duct plate and a duct, the duct aligning with an aperture defined by the duct plate.

11. The HVAC unit of claim 10, wherein the duct is fixed to the duct assembly by a fastening ring.

12. The HVAC unit of claim 10, wherein the duct plate is fixed to the housing by a plurality of removable fasteners.

13. The HVAC unit of claim 1, wherein the vent cover is fixed to the housing by a plurality of removable fasteners.

14. The HVAC unit of claim 1, wherein the duct assembly is fixed to the housing by a plurality of removable fasteners.

15. A duct assembly for a heating, ventilation, and air conditioning (HVAC) unit, the HVAC unit comprising: a housing defining a first airflow exit and a second airflow exit, the first airflow exit being separated from the second airflow exit by a portion of the housing; a vent cover configured to cover the first airflow exit; and a duct assembly configured to cover the second airflow exit; wherein the vent cover is configured to be disassembled from the housing and reassembled to cover the second airflow exit, the duct assembly is configured to be disassembled from the housing and reassembled to cover the first airflow exit, and the vent cover includes a top plate and a first fin, the first fin extending from the top plate;

the duct assembly comprising: a plate defining an aperture; and a duct fixed to the plate and aligning with the aperture; and a fastening ring configured to fasten the duct to the plate; wherein the plate includes a plurality of fastening apertures, each of the plurality of fastening apertures being configured to receive a removable fastener for fastening the plate to the housing of the HVAC unit; and wherein the plate includes a protrusion around a perimeter of the aperture, a first end of the duct being slideably received over the protrusion, and the fastening ring being configured to tighten the first end of the duct on the protrusion and fix the duct to the plate.

16. The duct assembly of claim 15, further comprising an end ring configured to cover a free end of the duct.

17. The duct assembly of claim 15, wherein the plate is sized to cover at least two airflow exits in the housing of the HVAC unit, the plate covering one of the at least two airflow exits at a time.

18. The duct assembly of claim 15, wherein the duct is one of two ducts fixed to the plate.

* * * * *